United States Patent [19]

Mochizuki et al.

[11] Patent Number: 4,760,506

[45] Date of Patent: Jul. 26, 1988

[54] LIGHT BULB MOUNTING STRUCTURE IN AUTOMOTIVE LAMP

[75] Inventors: Hideharu Mochizuki; Hiroyuki Makita; Akira Saijo, all of Shizuoka, Japan

[73] Assignee: Koito Manufacturing Co., Ltd., Tokyo, Japan

[21] Appl. No.: 16,825

[22] Filed: Feb. 20, 1987

[30] Foreign Application Priority Data

Feb. 20, 1986 [JP] Japan ..... 61-24335[U]
Mar. 25, 1986 [JP] Japan ..... 61-44078[U]
Dec. 18, 1986 [JP] Japan ..... 61-195335[U]

[51] Int. Cl.[4] ..... H01R 33/00

[52] U.S. Cl. ..... 362/226; 362/267; 362/61

[58] Field of Search ..... 362/226, 267, 61

[56] References Cited

U.S. PATENT DOCUMENTS 4,500,946 2/1985 Mikola ..... 362/226
4,609,977 2/1986 Eckhardt et al. ..... 362/267
4,631,651 12/1986 Bergin et al. ..... 362/61
4,682,274 7/1987 Freudenreich et al. ..... 362/226

*Primary Examiner*—E. Rollins Cross
*Attorney, Agent, or Firm*—Sughrue, Mion, Zinn, Macpeak and Seas

[57] ABSTRACT

A lamp socket assembly for an automotive headlamp, wherein a mount is formed at the back of the headlamp reflector. A socket fixture is screwed to the reflector at a rear surface of the lamp. The mount has a plurality of partial circumferential depressions. The socket fixture has corresponding cuts about its central hole. However, the cuts extend over only a portion of the depressions. A lamp has an integral socket with a focal point plate having a plurality of radially extending tongues. The tongues can be inserted through the cuts into the depressions and be engaged therein. In a dual lamp unit, one of the depressions of the mount for the auxiliary lamp can have a protrusion not present in the main lamp. The tongues for the main and auxiliary lamp sockets differ so that the main lamp socket cannot be engaged with the mount for the auxiliary lamp.

8 Claims, 9 Drawing Sheets

LIGHT BULB MOUNTING STRUCTURE IN AUTOMOTIVE LAMP

BACKGROUND OF THE INVENTION

1. Field of the Invention

This invention relates to a light bulb mounting structure in an automobile lamp.

More particularly the invention relates to a light bulb mounting structure for mounting a light bulb on an automobile lamp which is integral with a substantially L-shaped socket having a connector connecting part extended downwardly.

The invention also relates to the light bulb mounting structure in a motorcar headlight comprising a main lamp and an auxiliary lamp each of which uses a light bulb which is integral with a substantially L-shaped bulb socket whose connector connecting part is extended downwardly.

2. Background of the Invention

A conventional light bulb mounting structure of the type which is integral with an L-shaped socket with a downwardly extending connector is disadvantageous in a number of respects. It takes a number of components and a number of manufacturing steps to form the light bulb mounting structure. The mounting structure is high in manufacturing cost and the light bulb mounting operation is rather troublesome, involving much time and labor.

In a motorcar headlight of dual lamp type, the bulb sockets provided respectively for the main lamp and the auxiliary lamp are different from each other in the position of the positioning tongue which is radially extended from the focal point ring. Therefore, up to now, two different groups of components are provided for the main lamp and the auxiliary lamp, respectively. This duplication results in difficulties that the headlight is high in component cost, and the light bulbs are liable to be erroneously mounted on the lamps. That is, the light bulb for the main lamp may be mounted on the auxiliary lamp or the light bulb for the auxiliary lamp may be mounted on the main lamp.

Cross et al have disclosed in U.S. Pat. No. 4,373,711 a lamp socket in which a lamp base holding the bulb in inserted through a mounting hole with a side slot and then fixed by rotating the base so that a backing tab circumferentially moves away from the side slot. Mikola has disclosed in U.S. Pat. No. 4,513,356 a locking ring which rotates to lock a lamp base to a lamp socket on a reflector. The disclosure of Schmidt et al in U.S. Pat. No. 3,818,215 is somewhat similar to Mikola.

SUMMARY OF THE INVENTION

In view of the foregoing, an object of this invention is to provide a light bulb mounting structure for an automobile lamp which can be formed with a small number of components and with a small number of manufacturing steps and by which a light bulb can be mounted on or removed from an automobile lamp in one action.

Another object of this invention is to provide a motorcar headlight in which the main lamp and the auxiliary lamp have common components but nonetheless erroneous mounting of the light bulb is positively prevented.

The foregoing objects of the invention has been achieved by the provision of a light bulb mounting structure for an automobile lamp in which a socket integral with a light bulb is detachably fitted in the bulb mounting part of a reflecting mirror.

According to the first embodiment of the invention, a socket fixture is capped on the end portion of the bulb mounting part. The socket fixture has a plurality of engaging parts of substantially inverted-L shape in vertical section. A plurality of positioning tongues extend from the focal point ring of the socket are detachably engaged with the respective engaging parts.

According to the second and third embodiments of the invention, engaging grooves which are engaged with positioning tongues extended from the focal point ring of the socket are formed in the end face of the light bulb mount. Supporting bosses are provided on the reflecting mirror in such a manner as to surround the bulb mount. A fixture is secured to the supporting bosses to cover the end face of the bulb mount. The fixture has inserting inlets to guide the positioning tongues to the engaging grooves, and also has guides slightly curved upwardly respectively at the inserting inlets. The positioning tongues are detachably supported by the engaging grooves of the bulb mounting part and the fixture.

The foregoing object of the invention for a dual lamp has been achieved by the provision of a motor-car headlight comprising a main lamp and an auxiliary lamp. In each of the two lamps, engaging grooves engage with a positioning tongue and support tongues which are extended from a focal point ring of a bulb socket. The engaging grooves are formed into the end face of a cylindrical bulb mounting part of reflecting mirror. The bulb socket is supported by the engaging grooves and a socket fixture which covers the end face of the cylindrical bulb mounted part. According to the invention, the socket fixture has inserting inlets through which the positioning tongue and supporting tongues of the focal point ring are guided to the engaging grooves. For the auxiliary lamp, an erroneous-mounting preventing protrusion prevents the insertion of the positioning tongue of the main lamp bulb socket and is formed in the engaging groove adapted to engage with the positioning tongue of the auxiliary lamp bulb socket.

BRIEF DESCRIPTION OF THE DRAWINGS

FIG. 5 is a front view showing the light bulb mounting structure, FIG. 6 is a sectional view taken along line VI—VI in FIG. 5, and FIG. 7 is an exploded perspective view of the light bulb mounting structure.

FIG. 8 is a front view showing the second example of the light bulb mounting structure, FIG. 9 is a sectional view taken along line IX—IX in FIG. 8, and FIG. 10 is an exploded perspective view of the light bulb mounting structure shown in FIGS. 8 and 9.

DETAILED DESCRIPTION OF THE PREFERRED EMBODIMENTS

A first embodiment of this invention will be described with reference to the accompanying drawings.

Figure 1:
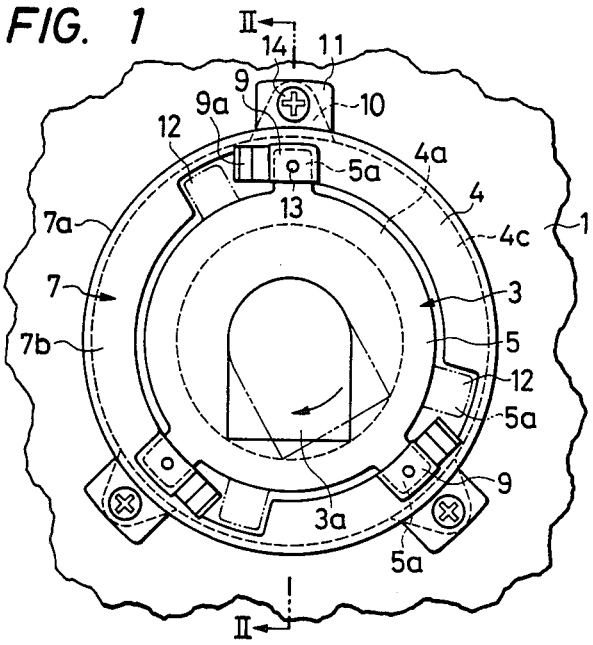
FIG. 1 is a front view of the light bulb mounting structure of a first embodiment of the invention.
Figure 2:
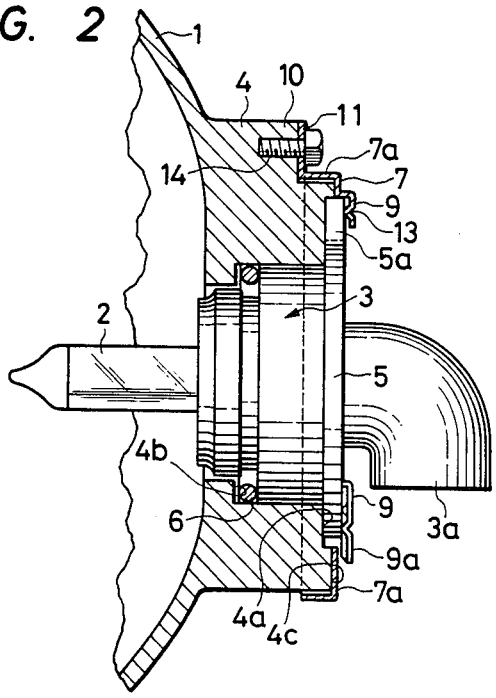
FIG. 2 is an enlarged sectional view taken along the line II—II in FIG. 1.
Figure 3:
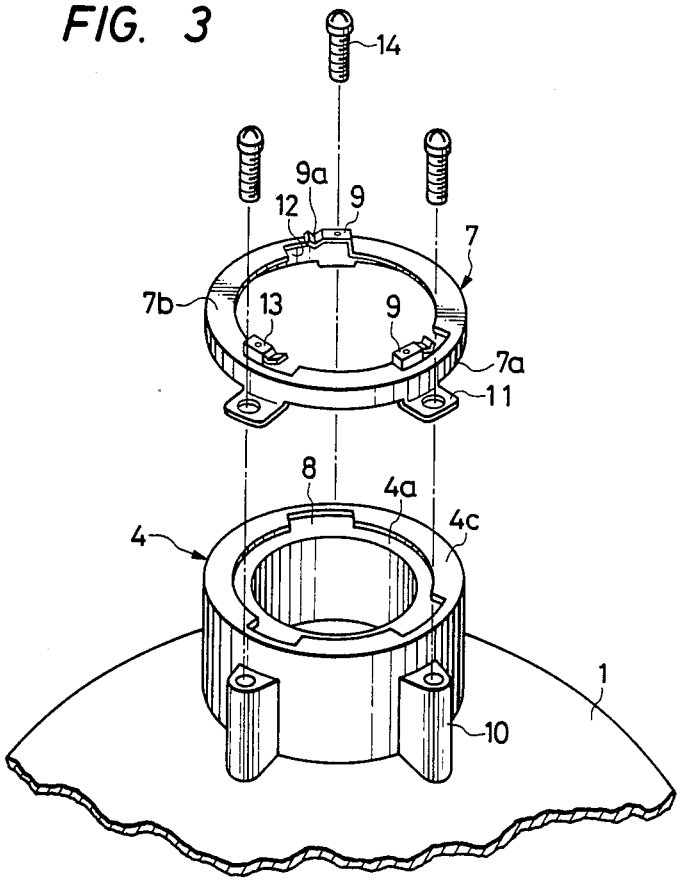
FIG. 3 is an exploded perspective view of the light bulb mounting structure.

In FIGS. 1, 2 and 3 are shown a reflecting mirror 1, a light bulb 2 and a socket 3.

The reflecting mirror 1 is formed by molding resin material as required. The reflecting mirror 1 has an opening at its rear end which is surrounded by a bulb mount 4. The bulb mounting part 4 is utilized to detachably mount the light bulb 2, namely, the socket 3 of the light bulb 2, on the reflecting mirror 1.

Figure 4:
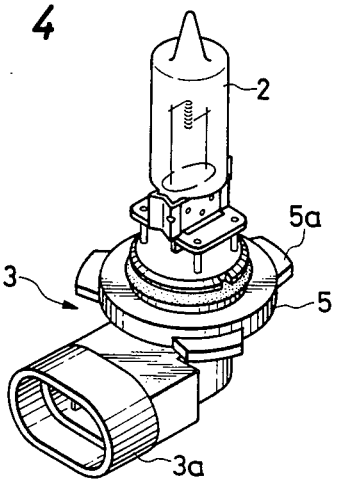
FIG. 4 is a perspective view of a integral bulb and socket.

The light bulb 2 is a standardized one, shown in perspective in FIG. 4. That is, the light bulb 2 is integral with the socket 3 which is substantially L-shaped having a connector connecting part 3*a* extended downwardly with respect to the car body. A light bulb of this type has been described in U.S. Pat. No. 4,609,977 to Eckhardt et al. The light bulb 2 is installed by detachably engaging the socket 3 with the bulb mount 4.

The bulb mount 4 is substantially cylindrical and is integral with the reflecting mirror 1 as was described above. A step 4*a* for receiving a focal point ring 5 of the socket 3 and a step 4*b* for supporting an "O" ring are formed in the inner wall of the cylindrical bulb mount 4 so that the socket 3 can be detachably engaged with the bulb mount 4. The bulb mount 4 has an end face 4*c* around the opening which is covered by a socket fixture 7. The socket fixture 7 is adapted to engaged with positioning tongues 5*a* extending from focal point ring 5 of the socket 3. In FIG. 3, cuts 8 in the end of the bulb mounting part 4 cooperate with engaging parts 9 (described later) of the socket fixture 7 to support the positioning tongues 5*a* of the socket 3.

The socket fixture 7 comprises a vertical part (or a skirt) 7*a* and a horizontal lip 7*b*. A plurality of mounting tabs 11 for fixedly mounting the socket fixture 7 on mounting bosses 10 of the bulb mount 4 extend radially outwardly from the skirt 7*a*. A plurality of engaging parts 9 for engaging with the positioning tongues 5*a* of the focal point ring 5 are formed by curving the horizontal lip 7*b* upwardly. Cuts 12 for introducing the positioning tongues 5 into the engaging parts 9 are formed in the horizontal lip 7*b* in such a manner that the cuts 12 are adjacent to the respective engaging parts 9.

The engaging parts 9 are used to lock the positioning tongues 5*a* of the focal point ring 5. Each of the engaging parts 9 is substantially inverted-L-shaped in vertical section and has an elastic substantially V-shaped locking piece 9*a* on the side of the cut 12 so as to positively hold the respective positioning tongue 5*a*. In the figures, protrusions 13 of the engaging parts 9 depress the positioning tongues 5*a* of the focal point ring 5 which have been introduced into the respective engaging parts 9.

The light bulb 2 is mounted on the lamp as follows. As shown in FIG. 3, the socket fixture 7 is mounted on the bulb mount 4 with screws 14 or the like in advance. The socket 3, which is integral with the light bulb 2, is inserted into the bulb mounting part 4 while the positioning tongues 5*a* of the ring 5 of the socket 3 are inserted into the respective cuts 12 of the socket fixture 7. Under this condition, the focal point ring 5 of the socket 3 is turned so that the positioning tongues 5*a* are moved under the locking pieces 9*a* of the engaging parts 9 and are engaged with the engaging parts 9. Thus, the light bulb 2 has been mounted on the lamp.

The light bulb mounting structure for an automobile lamp according to the invention is as described above. Its components are only the locking members. Therefore, the light bulb mounting structure of the invention can be formed with a relatively small number of components at a low manufacturing cost. Also the light bulb, i.e., the socket can be coupled to the bulb mounting part of the reflecting mirror in one action. Thus the aforementioned first object of the invention has been achieved.

Figure 5:
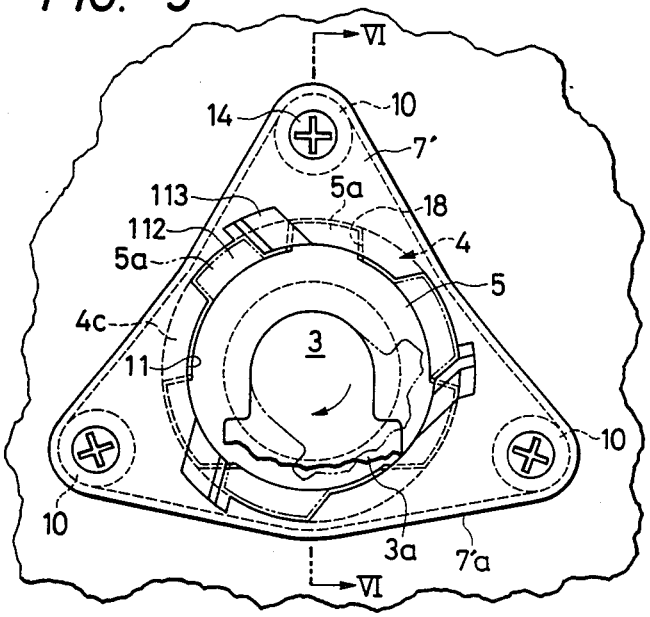
FIGS. 5, 6 and 7 show a second example of a light bulb mounting structure in an automobile lamp according to this invention. More specifically.
Figure 6:
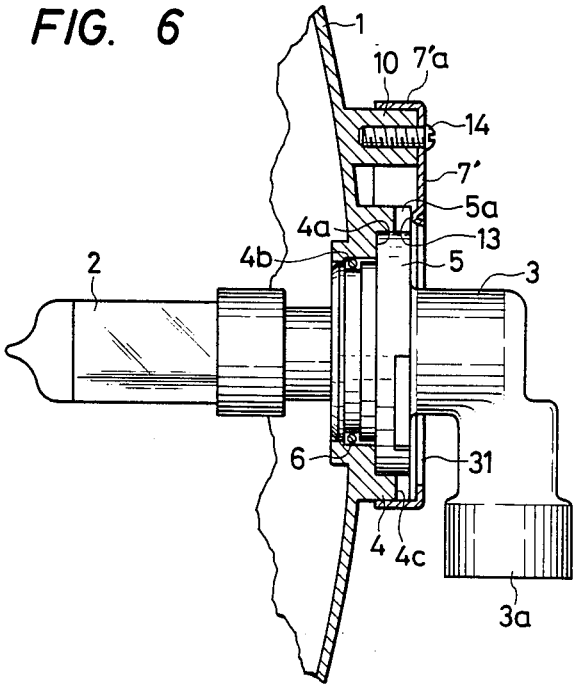
Figure 7:
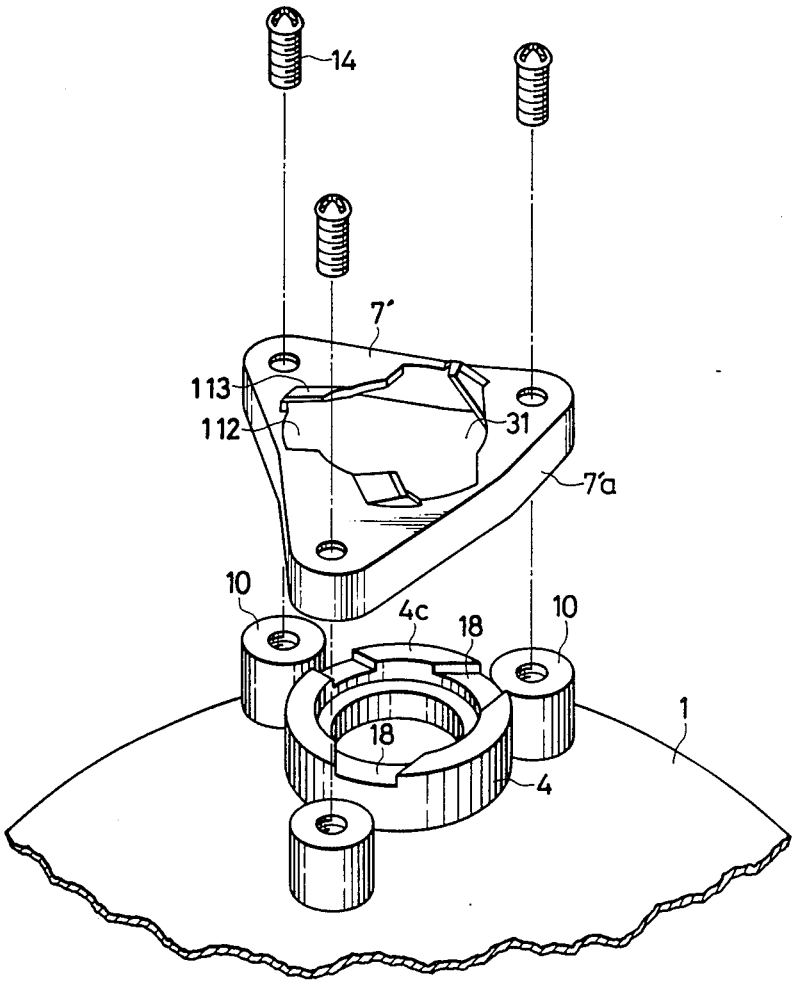

A second embodiment of the invention will be described with reference to FIGS. 5 through 7.

Supporting bosses 10 protrude from the reflecting mirror 1 in such a manner that they are located around the bulb mount 4. A socket fixture 7′ is mounted on the supporting bosses 10 in such a manner as to cover the end face 4*c* of the bulb mount 4.

The bulb mount 4 is substantially in the form of a cylinder which is integral with the reflecting mirror 1. Engaging grooves 18 are formed in the end face 4*c* so as to be engaged with the positioning tongues 5*a* extending radially outwardly from the focal point ring 5 of the socket 3. A step 4*a* supports the focal point ring 5 of the socket 3 and a step 4*b* supports an "O" ring 6 adapted to hermetically seal the inside of the bulb mount 4. Both steps 4*a* and 4*b* are formed into the inner wall of the bulb mount 4. The socket 3 is fitted in the bulb mount 4. The socket fixture 7′ is placed on the end face 4*c* of the bulb mount 4 and then secured to the supporting bosses 10.

As was described above, the supporting bosses 10 are integral with the reflecting mirror 1. For instance, three supporting bosses 10 are arranged at angular intervals of about 120° around the bulb mount 4 and are substantially flush with the bulb mount 4. The fixture 7′ covering the end face 4*c* of the bulb mounting part 4 is secured to the supporting bosses 10 with screws 14.

The fixture 7′ is made of metal plate or resin material so as to be able to cover the supporting bosses 10 and the end face 4*c* of the bulb mounting part 4. In the second embodiment shown in FIGS. 5 through 7, the fixture 7′ is made of metal plate. The fixture 7′ comprises a horizontal part which is substantially triangular in correspondence to the arrangement of the three supporting bosses 10 and a vertical part, namely, a skirt 7′*a* formed along the periphery of the horizontal part.

Figure 8:
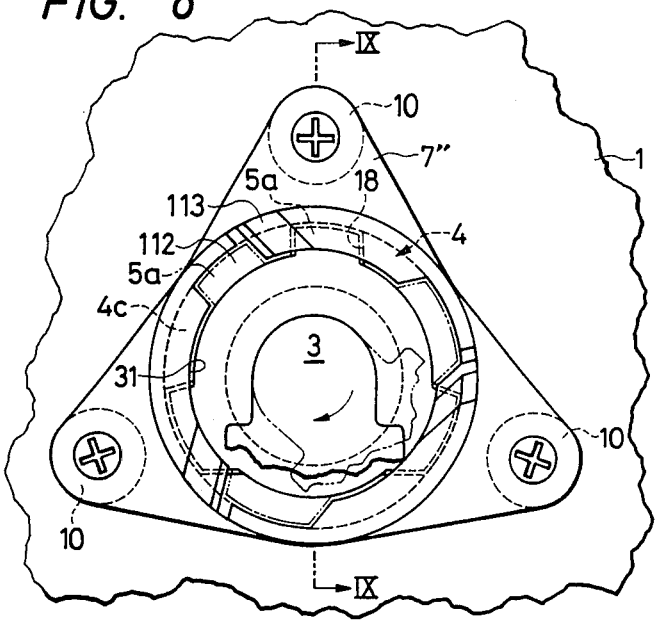
FIGS. 8, 9 and 10 shows a third example of the light bulb mounting structure according to the invention. More specifically.
Figure 9:
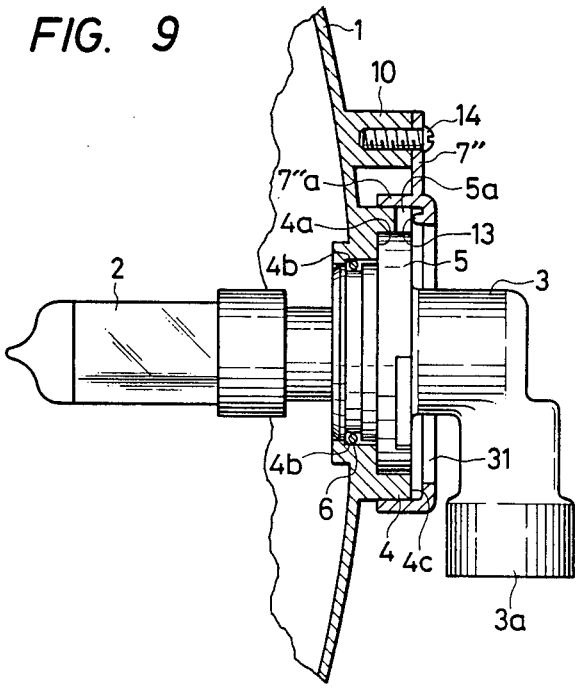
Figure 10:
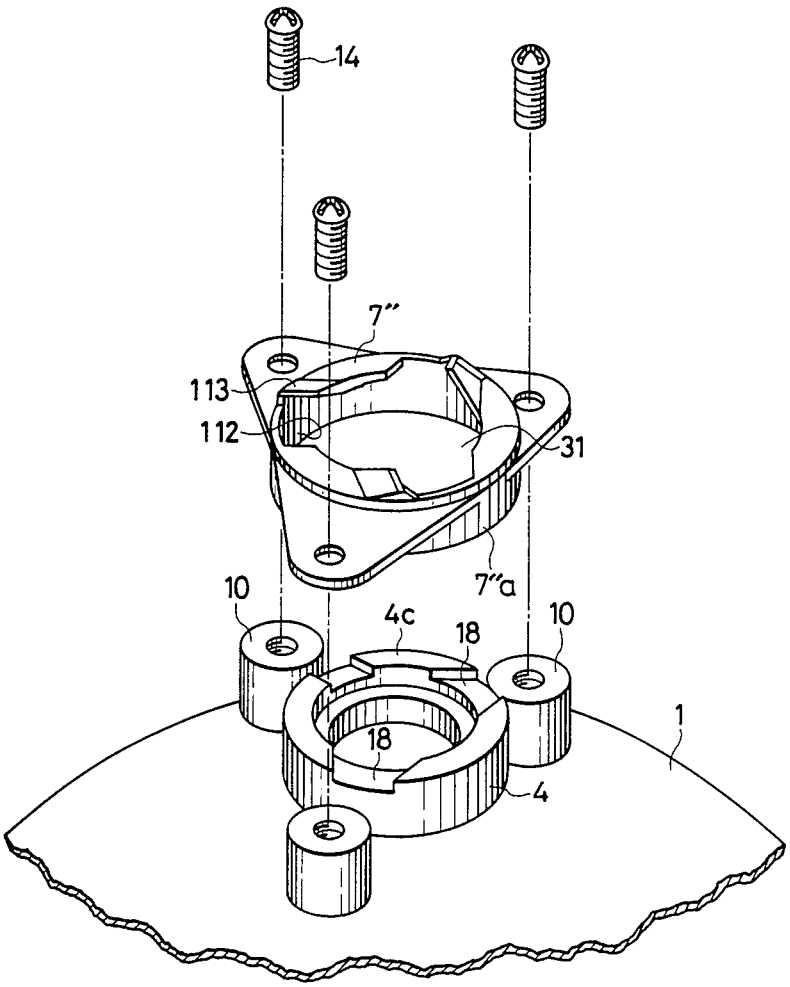

In a third embodiment shown in FIGS. 8 through 10, the fixture 7″ is formed by molding a resin material. The fixture 7″ comprises a horizontal part which is substantially triangular similarly as in the second embodiment and a cylindrical skirt 7″*a* formed at the center of the horizontal part in such a manner that it is extended downwardly so as to cover the cylindrical outer wall of the bulb mount 4.

A circular inserting hole 31 is formed in the horizontal part of each of the socket fixtures 7' and 7'' at the center. The inserting hole 31 thus formed is large enough to receive the focal point ring 5 of the socket 3. Inserting inlets 112 and guides 113 are formed in the horizontal part of the fixture 7' or 7'' along the inserting hole 31 (in such a manner that they are confronted with the end face 4c of the bulb mount 4). The inserting inlets 112 and the guides 113 are used to guide the positioning tongues 5a of the focal point ring 5 to the engaging grooves 18 formed in the end face 4c of the bulb mounting part 4.

In other words, the inserting inlets 112 are so positioned that, when the fixture 7' or 7'' is mounted on the bulb mount 4, they are confronted with the end face 4c of the bulb mount 4 as was described above, and are more displaced circumferentially than the engaging grooves 18 of the end face 4c. The inserting inlets 112 are large enough to receive the positioning tongues 5a of the focal point ring 5.

The guides 113 are used to guide the positioning tongues 5a of the ring 5, which have been inserted into the inserting inlets 112, to the engaging grooves 18 formed in the end face 4c of the bulb mounting part 4. The guides are also used to eliminate the difficulty that the positioning tongues 5a are unintentionally disengaged from the engaging grooves. The guides 113 are formed by slightly curving upwardly the horizontal part of the fixture 7' or 7'' respectively at the inserting inlets 112. In FIGS. 6 and 9, protrusions 13 of the fixture 7' or 7'' depress the positioning tongues 5a of the focal point ring 5 which have been engaged with the engaging grooves 18.

The light bulb 2 is mounted on the lamp as follows. The fixture 7' or 7'' is secured to the supporting bosses 10, to cover the end face 4c of the bulb mounting part 4 in advance. The socket 3 intergral with the light bulb 2 is fitted in the bulb mount 4 while the positioning tongues 5a of the focal point ring 5 of the socket 3 are inserted into the inserting inlets 112 of the fixture 7' or 7''. Under this condition, the ring 5 of the socket 3 is turned so that the positioning tongues 5a of the ring 5 are engaged with the engaging grooves 18 of the bulb mount 4 through the guides 113 and are held by the inner surface of the fixture 7' or 7''. Thus, the light bulb has been mounted on the automobile lamp.

The light bulb mounting structure for an automobile lamp according to the second and third embodiments of the invention is as described above. Therefore, its only additional component is the socket fixture. Accordingly, the light bulb mounting structure can be formed with a small number of components and with a small number of manufacturing steps, and provided at a low manufacturing cost. The light bulb, i.e., the socket can be coupled to the bulb mounting part of the reflecting mirror in one action, just as in the first embodiment.

On the rear side of the reflecting mirror, the bulb mounting part and the supporting bosses are covered by the fixture, and the outer surface of the fixture is substantially flat. Therefore, the light bulb mounting structure is simple in construction, having no useless protrusions. Accordingly, the automobile lamp with the bulb mounting structure is simple in maintenance, and the light bulb mounting structure will never interfere with the components around it.

A fourth embodiment of this invention will be now described with reference to the accompanying drawings.

Figure 11:
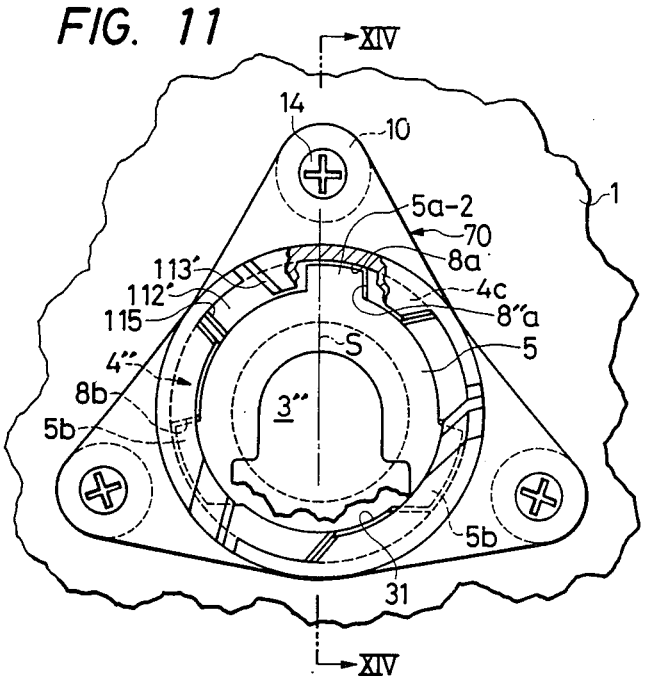
FIG. 11 is a front view, with parts cut away, showing one example of an auxiliary lamp in a motorcar head-light according to a fourth embodiment of this invention.
Figure 12:
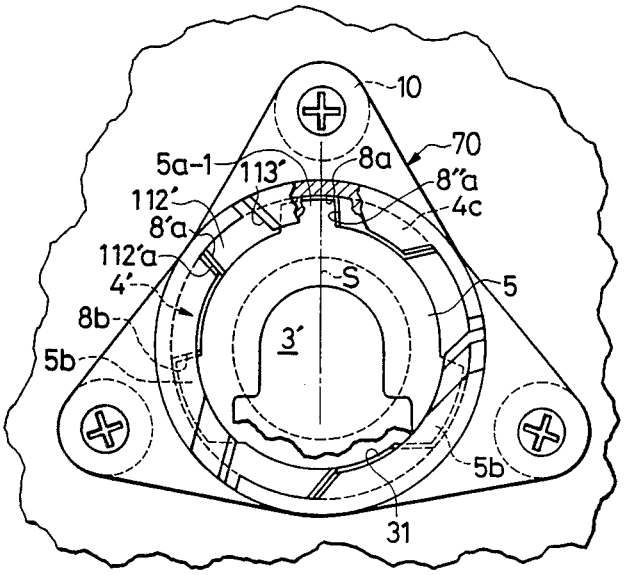
FIG. 12 is a front view, with parts cut away, showing one example of a main lamp in the head-light according to the fourth embodiment.
Figure 13:
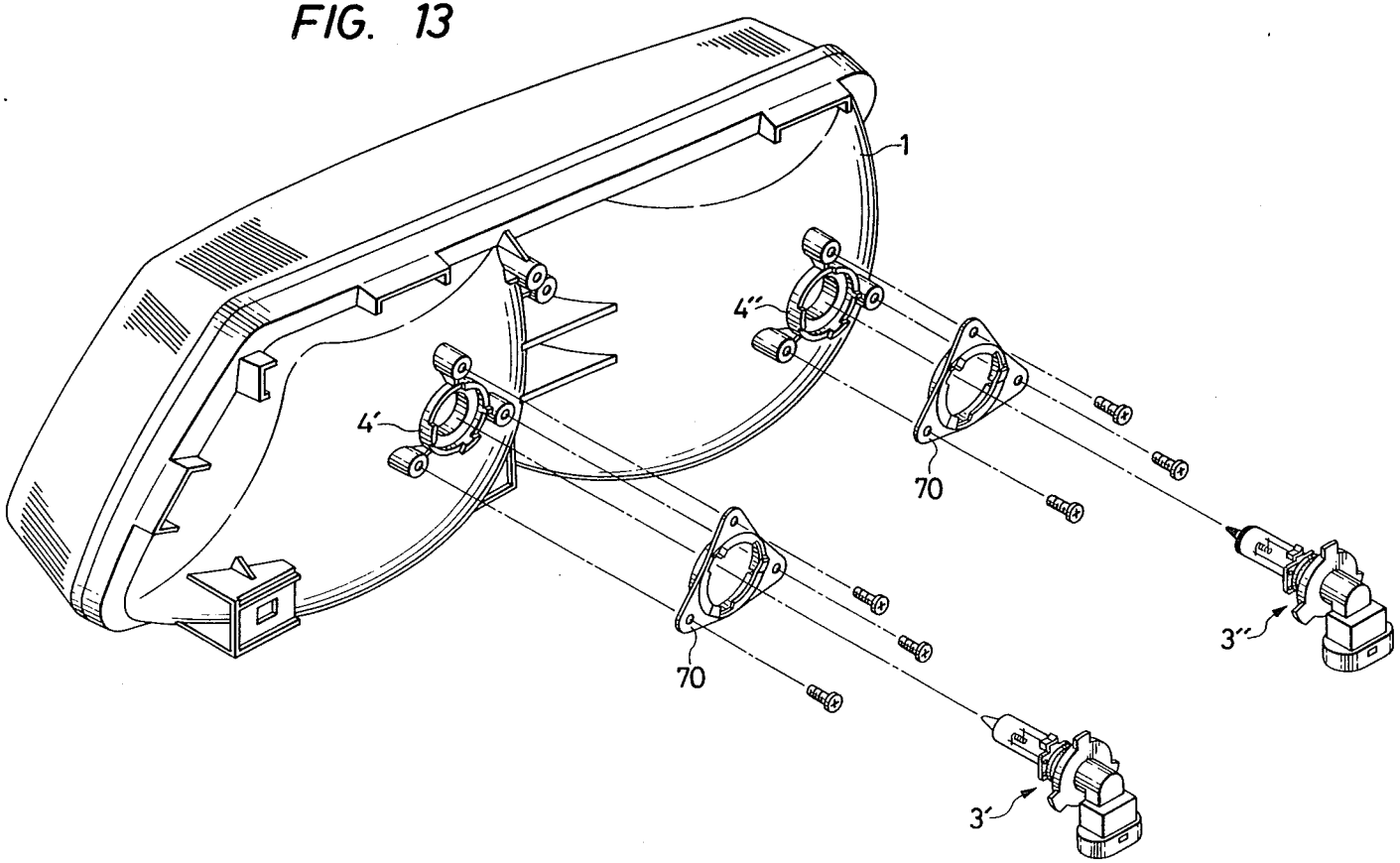
FIG. 13 is a perspective view of a dual-lamp head-light to which the fourth embodiment is applied.

FIG. 11 shows one example of an auxiliary lamp, and FIG. 12 shows one example of a main lamp. The auxiliary lamp and the main lamp form a dual-lamp motorcar headlight according to the second embodiment of the invention. As illustrated in the perspective view of FIG. 13, a main socket 3' and an auxiliary socket 3'' are both joined through respective socket fixtures 70 to respective mounts 4' and 4'' of a single reflector 1 having two focusing surfaces.

As in the first embodiment, in each of the two lamps, the light bulb 2 is connected to the substantially L-shaped bulb socket 3' or 3'' having the connector connecting part 3a which is extended downwardly. The substantially disc-shaped focal point ring 5 is secured to the bulb socket 3' or 3''. The focal point ring 5 is a standardized one having one positioning tongue 5a and two supporting tongues 5b which extend radially and are arranged at angular intervals of about 120°. According to the standard, the positioning tongue 5a-1 of the bulb socket 3' for the main lamp is so designed that the larger part of the positioning tongue 5a-1 is on the left side of the center line S as shown in FIG. 2, while the positioning tongue 5a-2 of the bulb socket 3'' for the auxiliary lamp is so designed that the larger part of the positioning tongue 5a-2 is on the right side of the center line S as shown in FIG. 11.

The two bulb mounts 4' and 4'' are substantially cylindrical and are integral with the reflecting mirror 1. Engaging grooves 8a and 8b are formed at angular intervals of about 120° in the end face 4c of the opening of each of the cylindrical bulb mounts 4' and 4'' so that they are engaged respectively with the positioning tongue 5a-1 or 5a-2 and the two supporting tongues 5b of the focal point ring 5. A step 4a supports the focal point ring 5 of the bulb socket 3 and a step 4b supports an "O" ring adapted to hermetically seal the inside of the lamp. The two steps 4a and 4b are formed on the inner wall of the cylindrical bulb mounting part 4' or 4''. The bulb socket 3' or 3'' is mounted on the bulb mount 4' or 4'' and socket fixtures 70 are placed on the end face 4c of the cylindrical bulb mounting part 4' or 4'' and secured to supporting bosses 10.

The socket fixture 70 is formed by molding resin material so as to cover the end face 4c of the bulb mount 4' or 4'' and the supporting bosses 10. More specifically, the socket fixture is formed as follows. The configuration of the socket fixture 70 is substantially triangular in correspondence to the arrangement of the three supporting bosses 10 and has at its center a cylindrical skirt 70a adapted to cover the outer wall of the bulb mount 4' or 4'' and a substantially circular inserting hole 31 which is large enough to receive the focal point ring 5 of the bulb socket 3. Also inserting inlets 112' and guides 113' are formed along the edge portion of the inserting hole 31 which confronts with the end face 4c of the bulb mount 4. The inserting inlets 112' and the guides 113' are used to guide the positioning tongue 5a and the supporting tongues 5b of the focal point ring 5 to the engaging grooves 8a and 8b formed in the end face 4c of the bulb mount 4.

More specifically, the inserting inlets 112' are formed as follows. The edge portion of the inserting hole 31 which confronts with the end face 4c of the bulb mounting part 4' or 4'' is cut to form the inserting inlets 112' in such a manner that the inserting inlets 112' are circumferentially displaced from the engaging grooves 8a and 8b formed in the end face 4c of the bulb mount 4' or 4''. The inserting inlets 112' are large enough to receive the positioning tongue 5*a* and the supporting tongues 5*b* of the focal point ring 5.

The guides 113′ are formed by slightly bending the edge portion of the inserting hole 112′ upwardly. The guides 113′ are used to guide the positioning tongue 5*a* and the supporting tongues 5*b* of the focal point ring 5 to the engaging grooves 8*a* and 8*b* formed in the end face 4*c* of the bulb mount 4′ or 4″. The guides 113′ are also used to prevent the difficulty that the positioning tongue 5*a* and the supporting tongues 5*b* of the ring 5 are unintentionally disengaged from the engaging grooves 8*a* and 8*b*.

Figure 14:
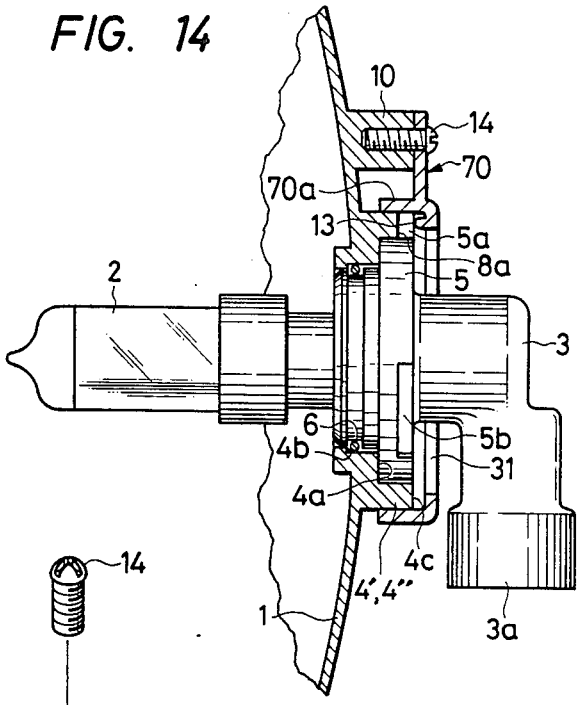
FIG.14 is a sectional view taken along the line XIV—XIV in FIG. 11.

As shown in FIG. 14 protrusions 13 of the socket fixture 70 depress the positioning tongue 5*a* and the supporting tongues 5*b* of the ring 5 which have been engaged with the engaging grooves 8*a* and 8*b* of the bulb mount 4′ or 4″.

Figure 15:
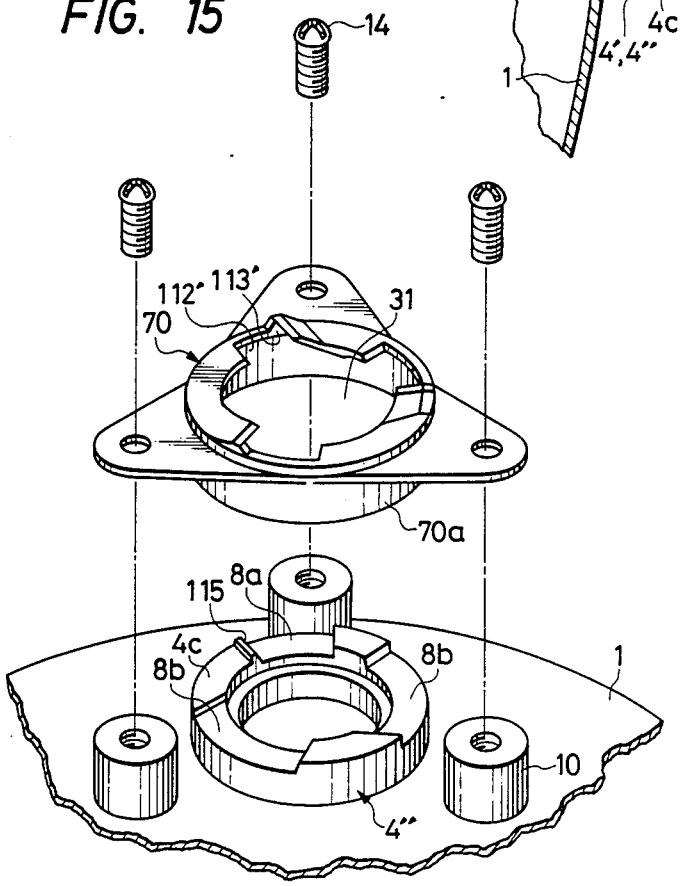
FIG. 15 is an exploded perspective view showing the auxiliary lamp of FIG. 11.

The engaging groove 8*a* of the bulb mount 4′, which engages with the positioning tongue 5*a* of the focal point ring 5, is slightly different in construction for the main lamp of FIG. 12 from the engaging groove 8*a* of the bulb mount 4″ for the auxiliary lamp of FIG. 11. This difference is used to eliminate the difficulty that the bulb socket 3 is erroneously mounted. As was described before, the positioning tongue 5*a*-1 of the main bulb socket 3′ lamp extends radially, according to the standard, in such a manner that its larger part is on the left side of the center line S. Therefore, as shown in FIG. 12, the engaging groove 8*a* of the bulb mount 4′ for the main lamp has its one end 8′*a* formed substantially at the same position as one end 112′*a* of the inserting inlet 112′ of the socket fixture 70 and has its other end 8″*a* formed on the right side of the center line S. On the other hand, the positioning tongue 5*a*-2 of the auxiliary bulb socket 3″ extends radially in such a manner that its larger part is on the right side of the center line. Therefore, the engaging groove 8*a* is formed as shown in FIG. 11. That is, an erroneous-mounting preventing protrusion 115, shown in FIGS. 11 and 15, is formed on the end face 4*c* of the bulb mount 4″ for the auxiliary lamp in such a manner that it can be observed through the inserting inlet 112′ of the socket fixture 70 and the other end 8″*a* of the engaging groove 8*a* is more displaced to the right of the center line S than in the case of the mount 4′ the main lamp. Accordingly, even if it is tried to mount the main lamp bulb socket 3′ on the auxiliary lamp of FIG. 11, the positioning tongue 5*a*, being obstructed by the erroneous-mounting preventing protrusion 115 of the engaging groove 8*a* of the mount 4″, cannot go into the guide 113′ of the socket fixture 70. That is, the main lamp bulb socket 3′ cannot be mounted on the auxiliary lamp. On the other hand, the auxiliary lamp bulb socket 3″ may be mounted on the main lamp (FIG. 12). However, since its positioning tongue 5*a* is more displaced to the right of the center line S than that of the main lamp bulb socket, the connector connecting part 3*a* is inclined to the left of the center line S at the end of connection, and therefore it can be readily found that the auxiliary bulb socket 3″ is erroneously mounted on the main lamp.

The bulb can be mounted on the lamp as follows. The socket fixture 70 is secured to the supporting bosses 10 to cover the end face 4*c* of the bulb mount 4 in advance. The bulb socket 3′ or 3″ combined with the bulb 2 is coupled to the bulb mount 4′ or 4″ while the positioning tongue 5*a* and the supporting tongues 5*b* of the focal point ring 5 of the bulb socket 3′ or 3″ are inserted into the inserting inlets 112′ of the socket fixture 70. Under this condition, the ring 5 is turned clockwise so that the positioning tongue 5*a* and the supporting tongues 5*b* of the ring 5 are engaged with the engaging grooves 8*a* and 8*b* of the bulb mount 4 through the guides 113′ and held by the inner surface of the socket fixture 70. Thus, the bulb has been mounted on the lamp. Even if, in this case, it is tried to mount the main lamp bulb socket 3′ on the auxiliary lamp, it is impossible because the positioning tongue 5*a* cannot go into the guide 113′ of the socket fixture 70, being obstructed by the erroneous-mounting prevention protrusion 115 formed in the positioning-tongue engaging groove 8*a* of the auxiliary lamp mount 4″.

The construction of the automotive headlight according to the invention is as described above. Therefore, in the headlight, the socket fixture is the only addition component for the bulb socket, and accordingly the headlight can be manufactured with a smaller number of components and a smaller number of components and a smaller number of manufacturing steps and can be completed at a lower manufacturing cost. Furthermore, the socket combined with the bulb can be mounted on the bulb mounting part of the reflecting mirror in one action.

For the auxiliary lamp in a dual-lamp unit, the erroneous-mounting preventing protrusion is formed in the engaging groove adapted to receive the positioning tongue of the bulb socket in order to prevent the insertion of the positioning tongue of the main lamp a bulb socket. Therefore, even if the same socket fixture is employed both for the main lamp and for the auxiliary lamp, the difficulty that the main lamp bulb socket is mounted on the auxiliary lamp or the auxiliary lamp bulb socket is mounted on the main lamp can be positively prevented.

Furthermore, the rear side of the reflecting mirror including the supporting bosses is covered by the socket fixture whose outer surface is substantially flat, that is, each of the lamps is simple in construction, having no useless protrusions. Accordingly, the headlight is simple in maintenance, and will never interfere with the components around it.

Thus, the second object of the invention has been achieved.

What is claimed is:

1. A lamp assembly, comprising:

a reflective mirror having at a rear side thereof a bulb mount;

a bulb integral with a socket, said socket having a circumferential ring with a plurality of positioning tongues extending radially therefrom; and a socket fixture attachable to a rear end of said mount and having a plurality of engaging parts having a first portion extending from said socket fixture in a first direction away from said mirror and a second portion connected to said first portion and extending away from first portion in a direction substantially perpendicular to said first direction, said positioning tongues being engageable with said engaging parts.

2. A lamp assembly as recited in claim 1, wherein said mount has a plurality of depressions beneath a first surface and wherein said socket fixture has a second surface abuttable against said first surface and has a plurality of cuts in said second surface extending radially outward from a central aperture of said socket fixture, said cuts overlapping only portions of said depressions when said socket fixture is attached to said mount.

3. A lamp assembly as recited in claim 2, wherein said engaging parts comprise spring members opening into said cuts.

4. A lamp assembly as recited in claim 2, further comprising guiding surfaces inclined circumferentially of said aperture and formed in said socket fixture extending away from said second surface adjacent said cuts.

5. A lamp assembly, comprising:

a reflective mirror having at a rear side thereof a bulb mount having a plurality of engaging grooves formed in a rear surface of said mount facing away from said mirror;

a bulb integral with a socket, said socket having a circumferential ring with a plurality of positioning tongues extending radially therefrom; and a socket fixture attachable to said rear surface of said mount and having cuts extending radially outward from a central aperture of said socket fixture for insertion of said positioning tongues, said positioning tongues being engageable between said socket fixture and said engaging grooves.

6. A lamp assembly as recited in claim 5, wherein said socket fixture further comprises guides inclined away from said mirror at a side of said cuts.

7. A lamp assembly as recited in claim 6, further comprising supporting bosses formed on said rear side of said mirror surrounding said mount and means for attaching said socket fixture to said supporting bosses.

8. A lamp assembly as recited in claim 5:

wherein said mirror has a first one and a second one of said mounts for engaging respectively a first one and a second one of said sockets with respective ones of two of said socket fixtures;

wherein said first socket has a first positioning tongue of different configuration from a corresponding second positioning tongue of said second socket; and wherein a first engaging groove of said first mount has a protrusion not present in a corresponding second groove of said second mount, whereby said first socket is engageable with said first mount but said second socket is not engageable with said first mount.

* * * * *